US011491797B2

(12) United States Patent
Chick et al.

(10) Patent No.: US 11,491,797 B2
(45) Date of Patent: Nov. 8, 2022

(54) PRINT MATERIALS REPLENISHMENT

(71) Applicant: Hewlett-Packard Development Company, L.P., Spring, TX (US)

(72) Inventors: Andrew P. Chick, Vancouver, WA (US); Kenneth K. Smith, Boise, ID (US); Matthew James Storey, Austin, TX (US); Pratik Shah, San Diego, CA (US); Luke Kim, Seongnam-si (KR); Sean Daniel Fitzgerald, Boise, ID (US); Mathew Lavigne, Boise, ID (US); Jeffrey H. Luke, Boise, ID (US); Jiwon Moon, Seongnam-si (KR); Minchul Lee, Seongnam-si (KR); Corbett Benjamin Schoenfelt, Austin, TX (US); Bennett Alexander Nadeau, Austin, TX (US); Zackary Thomas Hickman, Austin, TX (US); Jefferson Blake West, Austin, TX (US); Muriel Hale Shields, Austin, TX (US); An Tran, Austin, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 71 days.

(21) Appl. No.: 17/047,219

(22) PCT Filed: Aug. 30, 2018

(86) PCT No.: PCT/US2018/048769

§ 371 (c)(1),
(2) Date: Oct. 13, 2020

(87) PCT Pub. No.: WO2020/046321

PCT Pub. Date: Mar. 5, 2020

(65) Prior Publication Data

US 2021/0379901 A1 Dec. 9, 2021

(51) Int. Cl.
*B41J 2/175* (2006.01)

(52) U.S. Cl.
CPC ..... *B41J 2/17513* (2013.01); *B41J 2/17523* (2013.01); *B41J 2/17596* (2013.01)

(58) Field of Classification Search
CPC ..... B41J 2/17503; B41J 2/17506; B41J 2/17509; B41J 2/17513; B41J 2/1752;
(Continued)

(56) References Cited

U.S. PATENT DOCUMENTS 4,060,105 A 11/1977 Feldeisen et al.
4,304,273 A 12/1981 Caudill et al.
(Continued)

FOREIGN PATENT DOCUMENTS

CN 101163594 A 4/2008
CN 104049495 A 9/2014
(Continued)

*Primary Examiner* — Anh T Vo
(74) *Attorney, Agent, or Firm* — Jefferson IP Law, LLP

(57) ABSTRACT

In some examples, a print materials container can include a dispense mechanism to dispense print materials directly to an in-situ reservoir of a printing device, a lock feature to engage a fill port during connection of the dispense mechanism to the fill port, and a valve integrated with the dispense mechanism for connecting the dispense mechanism to the fill port of the reservoir and comprising an output opening offset from a center axis of a tip of the dispense mechanism. The valve can open responsive to rotation of the valve opening with respect to the lock feature such that opposite openings align.

16 Claims, 10 Drawing Sheets

(58) Field of Classification Search
CPC ..... B41J 2/17523; B41J 2/17546; B41J 2/17596; G03G 15/08; G03G 15/0863
See application file for complete search history.

(56) References Cited

U.S. PATENT DOCUMENTS

| | | | | |
|---|---|---|---|---|
| 5,646,664 | A | 7/1997 | Pawlowski, Jr. | |
| 6,158,851 | A | 12/2000 | Zepeda | |
| 6,259,877 | B1 | 7/2001 | Taniyama et al. | |
| 7,937,029 | B2 * | 5/2011 | Murase | G03G 15/0872 399/262 |
| 8,050,597 | B2 * | 11/2011 | Yoshizawa | G03G 15/0879 399/261 |
| 8,590,742 | B2 | 11/2013 | Devos et al. | |
| 8,678,571 | B2 * | 3/2014 | Wagner | B41J 2/17523 347/85 |
| 9,046,820 | B1 | 6/2015 | Yamada et al. | |
| 2004/0061749 | A1 | 4/2004 | Corby et al. | |
| 2008/0279593 | A1 | 11/2008 | Kitaoka | |
| 2011/0181672 | A1 | 7/2011 | Wagner et al. | |
| 2012/0219318 | A1 | 8/2012 | Yoshida et al. | |

FOREIGN PATENT DOCUMENTS

| | | | |
|---|---|---|---|
| CN | 204249557 | U | 4/2015 |
| EP | 0 689 104 | A1 | 12/1995 |
| EP | 0 722 837 | A1 | 7/1996 |
| EP | 0 808 717 | A2 | 11/1997 |
| EP | 1 209 537 | A2 | 5/2002 |
| EP | 2 261 751 | A2 | 12/2010 |
| KR | 10-1996-0701786 | A | 3/1996 |
| KR | 10-2000-0068484 | A | 11/2000 |
| WO | WO-2010/044788 | A1 | 4/2010 |
| WO | WO-2012/145343 | A2 | 10/2012 |

* cited by examiner

PRINT MATERIALS REPLENISHMENT

BACKGROUND

Printing devices such as printers, copiers, large format, plotters, 3D-printers, etc. deposit various materials onto a medium, substrate, or platform to form objects or markings human visible, or machine detectable, in various wavelengths across the light spectrum otherwise referred to as text, graphics, images, reproductions, shadings, highlights, constructs, objects, print jobs, etc.). In some examples, printing devices may form markings on a physical medium by performing a process such as a print job. A print job can include forming markings such as text and/or images by, in part, by transferring and or depositing print materials to the physical medium as part of an overall print process.

DETAILED DESCRIPTION

Figure 1:
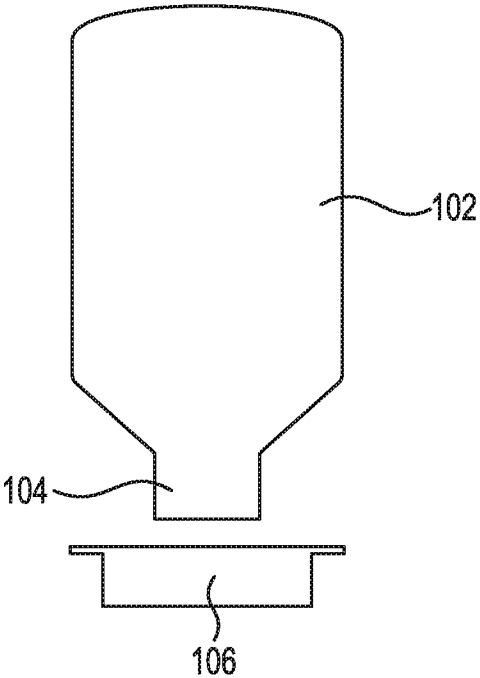
FIG. 1 illustrates an example of a print materials container consistent with the disclosure.

Printing devices may include a supply of a print materials located in a reservoir. As used herein, the term "print materials" refers to a substance which, when applied to a medium, can form representation(s) on the medium during a print job. In some examples, the print materials can be deposited in successive layers to create three-dimensional (3D) objects. For example, print materials can include print material particles, a toner material, a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print materials can be particles with an average diameter of less than one hundred microns. For example, the print materials can be particles with an average diameter of between 0-100 microns. However, examples of the disclosure are not so limited. For example, print materials can be particles with an average diameter of between 20-50 microns, 5-10 microns, or any other range between 0-100 microns. The print materials can be fused when deposited to create 3D objects.

The print materials can be deposited onto a physical medium. As used herein, the term "printing device" refers to any hardware device with functionalities to physically produce representation(s) on the medium. In some examples, the printing device can be a 3D printer. For example, the 3D printer can create a representation (e.g., a 3D object) by depositing print materials in successive layers to create the 3D object.

The reservoir including the print materials may be inside of the printing device and include a supply of the print materials such that the printing device may draw the print materials from the reservoir as the printing device creates the images on the print medium. As used herein, the term "reservoir" refers to a container, a tank, and/or a similar vessel to store a supply of the print materials for use by the printing device.

As the printing device draws the print materials from the reservoir, the amount of print materials in the reservoir may deplete. As a result, the amount of print materials in the reservoir of the printing device may have to be replenished.

A print materials container may be utilized to replenish a the reservoir of the printing device with print materials. For instance, the print materials container can be a print materials replenishment device. During an initial fill or replenishment operation, the print materials container can transfer print materials from the print materials container to the reservoir of the printing device.

Some approaches to initially filling or replenishing a reservoir of printing device include replacing a print materials reservoir. In such approaches, a printing device is opened, a print materials reservoir is removed from the printing device, and a new print materials reservoir is installed. In some approaches, the printing device may have more than one print materials reservoir, meaning a user is required to know which print materials reservoir to remove and replace.

In other approaches, the print materials reservoir is removed, replenished outside of the printing device, and returned to the printing device. This can be a messy process that can result in spills and/or environment contamination. Over- or under-filling of a print materials reservoir may also occur due to user error or inefficient fill methods.

In contrast, examples of the present disclosure include a print materials container that allows for replenishment of a print materials reservoir in-situ. For instance, the print materials reservoir can be coupled to a fill port of the print materials reservoir that can receive the print materials reservoir container. The print materials container can fill and/or replenish the print materials reservoir in-situ such that the print materials reservoir remains within a printing device during filling/replenishing. For instance, some examples of the present disclosure allow for filling/replenishing of print materials in a manner that may be more convenient, faster, and simpler for a user as compared to other approaches. For instance, a plurality of mechanisms can be used in the print materials container to make a filling/replenishing process easier and cleaner.

In some instances, by filling/replenishing the print materials reservoir in-situ using the print materials container, printing and/or operating costs (e.g., costs-per-page) can be reduced because a print materials container is sufficient for refilling a print materials reservoir. Because the print materials container may include limited or no gears, motors, electronics, etc., the cost to make and distribute the print materials container may be reduced. This reduction can result in cost savings for a user.

FIG. 1 illustrates an example of a print materials container 100 consistent with the disclosure. Print materials container 100 can include a dispense mechanism 102 and a valve 104. Dispense mechanism 102 can dispense print materials directly to an in-situ reservoir of a printing device. Valve 104 can be integrated with dispense mechanism 102, in some examples, and can facilitate connection of dispense mechanism to a fill port 106 of the reservoir. Valve 104, in some examples, can include an output opening, as will be described further herein, that is offset from a center axis of a tip of dispense mechanism 102. Valve 104 can open responsive to rotation of the valve opening with respect to a lock feature such that opposite openings align. The open valve can facilitate a plunger of dispense mechanism 102 (not pictured in FIG. 1) to push the print materials through the aligned openings into the reservoir. The lock feature (not illustrated in FIG. 1) can engage fill port 106 during connection of dispense mechanism 102 to fill port 106.

Dispense mechanism 102 can include plurality of mechanisms, as will be discussed further herein, including a compression mechanism, a squeeze bottle mechanism, a print materials bag mechanism, a bulb pump mechanism, and/or an accordion-shaped collapsible container, among others. In some instances, dispense mechanism 102 can include a print material reservoir to store a supply of print materials. The print material reservoir can supply/resupply a printing device (e.g., a host print system) with print materials, as is further described herein.

In some examples, print materials container 100 can be prepared for dispensing print materials by agitating print materials container 100 and inserting print materials container 100 into fill port 106. Docking of print materials container 100 can include locking print materials container 100 to fill port 106, allowing print materials container 100 to open along with an opening in the reservoir. This can allow transfer of print materials to the reservoir. Responsive to an indication that transfer is complete, print materials container 100 can be unlocked and undocked, which closes openings in print materials container 100 and the reservoir. Print materials container 100 can be removed from fill port 106, completing the print materials transfer.

Figure 2:
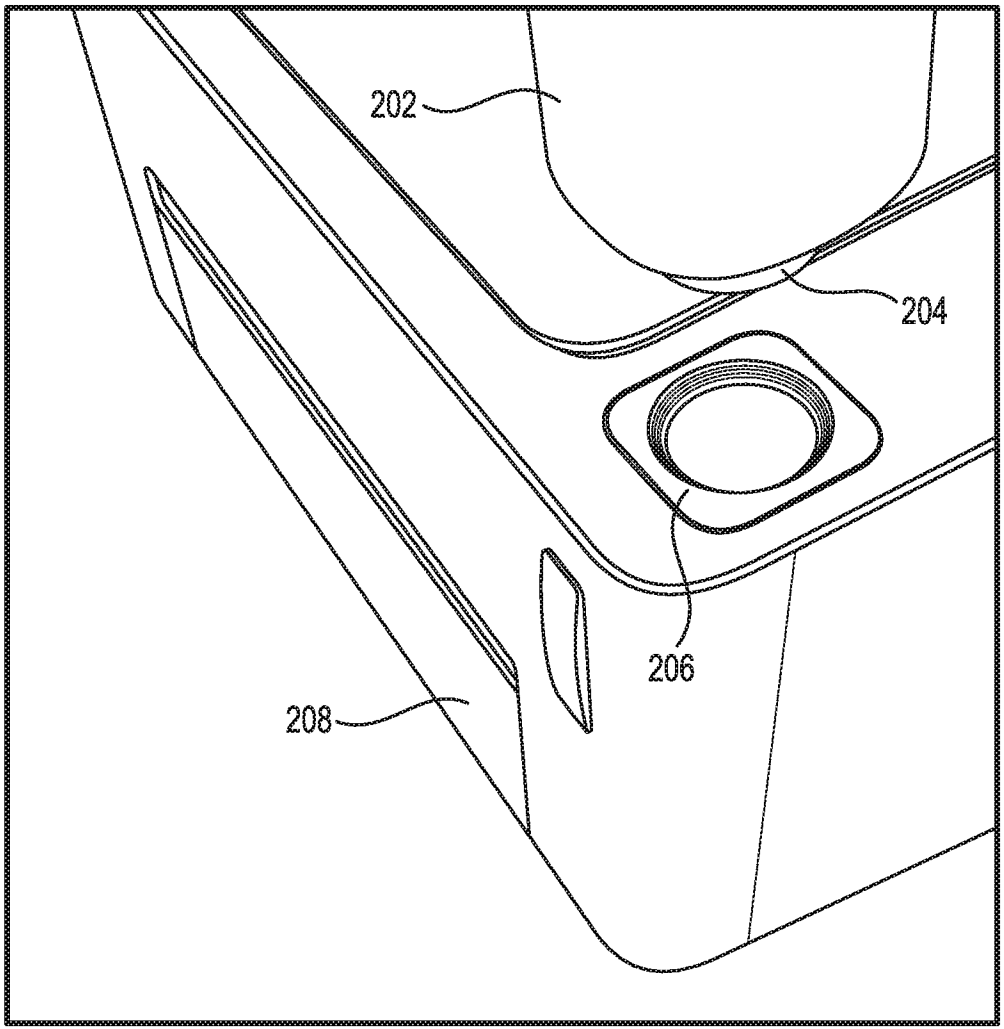
FIG. 2 illustrates an example of a print materials container and a printing device consistent with the disclosure.

FIG. 2 illustrates an example of a print materials container 200 and a printing device 208 consistent with the disclosure. Print materials container 200 can be coupled to printing device 208 via valve 204 and fill port 206. While one fill port 206 on top of printing device 208 is illustrated in FIG. 2, more than one fill port may be present on printing device 208 in some examples and/or a fill port may be located elsewhere on printing device 208. For instance, a fill port may be present on a side of printing device 208 or on a plurality of sides of printing device 208, a plurality of fill ports may be present on a side of printing device 208 or on a plurality of sides of printing device 208, and/or a plurality of fill ports may be present on top of printing device 208, among other options.

Printing device 208 can house a reservoir for receiving print materials from print materials container 202. The reservoir may remain in printing device 208 during filling/replenishing of the reservoir. Upon completion of the fill/refill, print materials container 202 can be removed from printing device 208 (e.g., valve 206 removed from fill port 206) and a print job can resume/commence.

Figure 3:
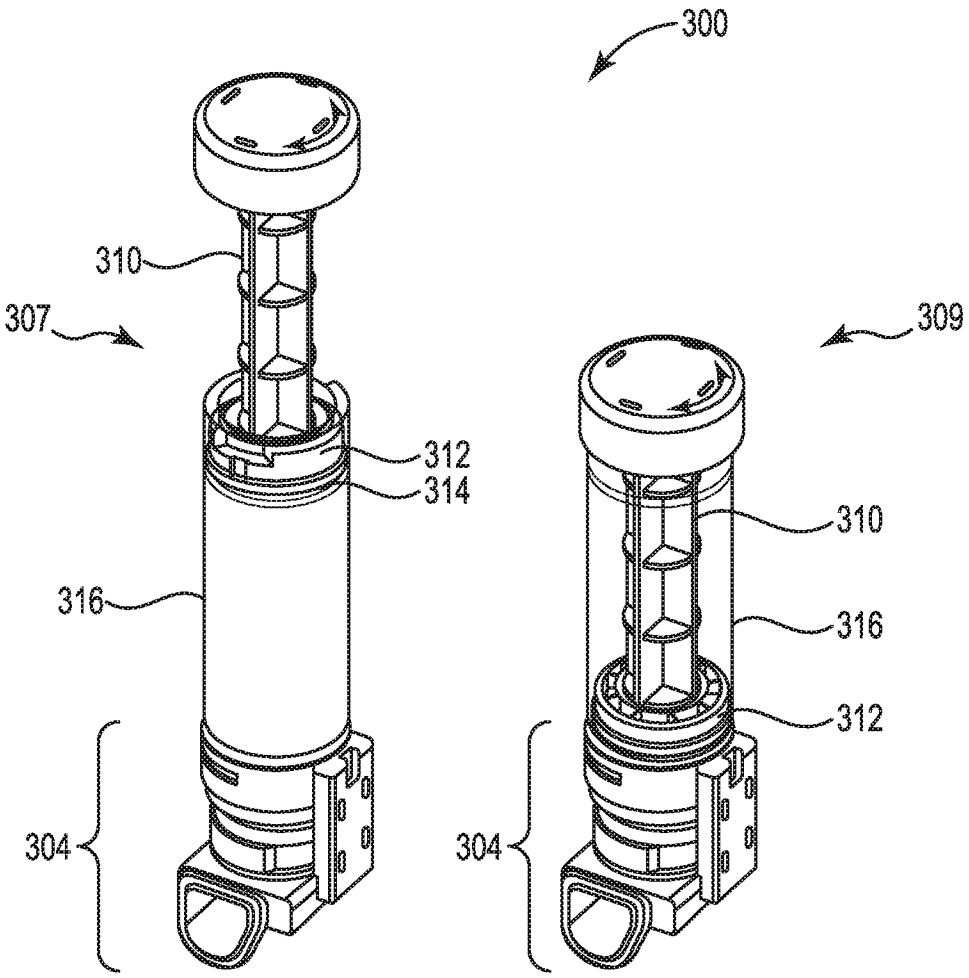
FIG. 3 illustrates an example of a print materials container having a compression mechanism in a first position and a second position consistent with the disclosure.

FIG. 3 an example of a print materials container 300 having a compression mechanism in a first position 307 and a second position 309 consistent with the disclosure. As used herein, the terms "compress" or "compression mechanism" refers to a reciprocating pump including a plunger and a tube, where the plunger can be linearly moved to allow the compress to take in and/or expel liquid, gas, or other material through an orifice at the end of the tube. A compress, in some examples, can include a syringe, and a compression mechanism in some examples can include a syringe mechanism. Print materials container 300 can include outer compress body 316 and a plunger 310. Outer compress body 316 can include an outer structure of the compression mechanism. For example, outer compress body 316 can be an outer structure of print materials container 300 and can include plunger 310 a base 312, and/or an inner compress body discussed further herein.

As used herein, the term "plunger" refers to a piston to take in and/or expel liquid, gas, or other material through an orifice at the end of print materials container 300. For example, print materials container 300 can include an inner compress body (not illustrated in FIG. 3) that can be a print materials reservoir. For example, the print materials reservoir can store a supply of print materials. The print materials reservoir can supply/resupply a printing device (e.g., a host print system). Plunger 310 can take in and/or expel the print materials from the print materials reservoir, and plunger 106 can be a structure to adapt a volume of the print materials reservoir. For example, plunger 310 can increase or decrease a volume of the print materials reservoir based on movement of plunger 310 in the print materials reservoir.

Plunger 310 can have a base 312, which can be a rubber material or other material for moving print materials. Base 312, in some examples, can include a seal 314 coupled to plunger 310 via base 312 to protect plunger 310 from print materials and sweep the print materials within the compression mechanism. Seal 314 can be a felt material wipe seal or a synthetic material wipe seal, among other seals that prevent air from escaping around base 312. Seal 314 can allow for a more constant pressure on print materials as compared to a plunger 310 and base 312 without a seal, in some instances. In some examples, plunger 310 and/or base 312 may be removed from the compression mechanism (e.g., for cleaning, replacement of components, etc.).

Print materials container 300 can include a valve 304, in some examples. The valve can be an opening through which material can be moved. For example, valve 304 can be an opening through which print materials can be moved in response to plunger 310 decreasing the volume of the print materials reservoir based on movement of plunger 310 from position 307 to position 309.

While in position 307, print materials container 300 is not depressed. In such an example, a print materials reservoir within print materials container 300 can contain print materials. While in position 309, print materials container 300 and it's print materials reservoir are void of print materials (e.g., having filled/refilled a printing device).

Although not illustrated in FIG. 3 for clarity and so as not to obscure examples of the disclosure, the print materials container 300 can be coupled to a printing device via valve 304 and a fill port of the printing device. For example, the print materials container 300 can be connected to a printing device so that print materials may be supplied to the printing device so that the printing device can perform print jobs, Plunger 310 can be depressed to expel print materials from print materials container 300 to the printing device. For instance, plunger 310 can be depressed from first position 307 to second position 309. For example, print materials container 300 can be connected to the printing device such that, during a fill and/or refill operation, plunger 310 can be moved from first position 307 to second position 309 to expel print materials from the print materials reservoir to the printing device. The print materials can fill/refill the printing device such that the printing device can continue to perform print jobs.

In some examples, print materials container 300 can be a toner materials container, and can include a dispense mechanism (e.g., a compression mechanism) to dispense toner materials to an in-situ reservoir of a printing device. In such an example, the dispense mechanism can include compress storing the toner materials and having plunger 310 to dispense the toner materials responsive to a force applied at an end of the plunger. For instance, a force can be applied at the end of the plunger which creates pressure to drive air and print materials out of the compression mechanism. The compress can include a tip (not illustrated here), as will be discussed further herein with respect to FIGS. 4-7, that includes a lock feature to lock to a fill port of the reservoir. In some instances, valve 304 can be a rotating value integrated with the tip of the compress. In such an example, valve 304 can open responsive to rotation of valve 304 with respect to the lock feature and connection and rotation of the tip with respect to the fill port. While a toner materials container is described in this example, other material particles containers may be used.

Figure 4:
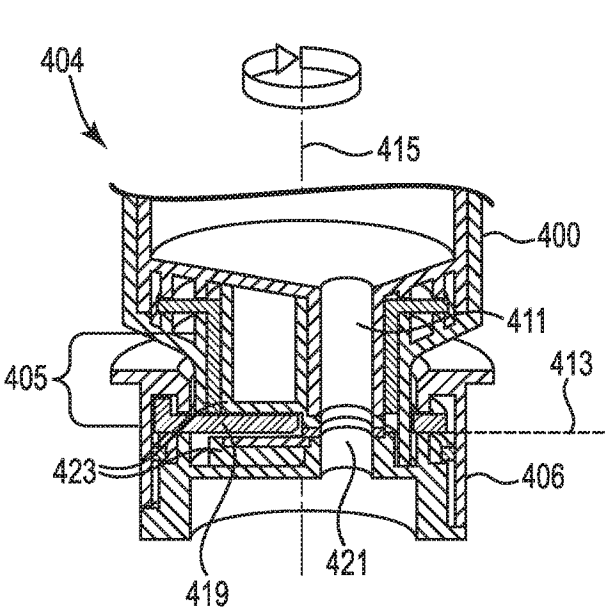
FIG. 4 illustrates an example of a valve locked to a replenishment port of a reservoir of a printing device consistent with the disclosure.

For instance, FIG. 4 illustrates an example of a valve 404 locked to a fill port 406 of a reservoir of a printing device consistent with the disclosure. Valve 404, in some examples can be integrated with a tip 405 of a compress 400. The compress tip 405 can include a lock feature to lock to fill port 406 of a print materials reservoir. Valve 404 can be a rotating valve that opens responsive to rotation of valve 404 (e.g., about axis 415) with respect to the lock feature, as well as connection and rotation of the compress tip 405 with respect to fill port 406, Valve 406 can prevent exposure of a compress tip 405 or fill port entrance 421 to a user. For instance, during docking and undocking, compress tip 405 swaps places with a cover 419 of fill port 406. This can result in compress tip 405 and an entrance 421 to fill port 406 in direct contact with each other. This can prevent residual print materials from falling out of the compress during removal by allowing fill port 406 to cleanly shear (e.g., at shear plane 413) a print materials column 411 between wipe seals 423.

In some examples, valve 406 can include an output opening, for instance at an end of print materials column 411, that is offset from a center axis of tip 450. During locking, a lock feature can engage fill port 406 during connection of tip 405 to fill port 406. Valve 404 can open responsive to rotation of an opening of valve 404 with respect to the lock feature such that opposite openings align. The open valve 404, in some instances can facilitate a plunger to push toner materials through aligned openings into the reservoir.

In the example illustrated in FIG. 4, compress 400 is locked to fill port 406, such that print materials may pass through print materials column 411. While not illustrated here, prior to rotation of valve 404, valve 404 may not be locked with fill port 406, meaning print materials column 411 would be closed off and print materials would be unable to pass.

Figure 5:
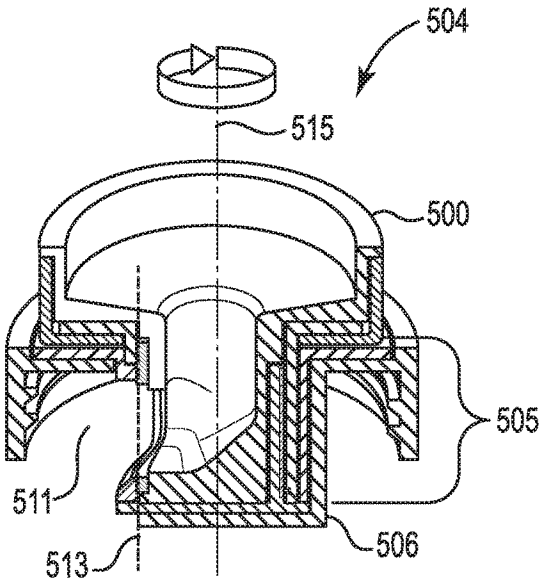
FIG. 5 illustrates another example of a valve locked to a replenishment port of a reservoir of a printing device consistent with the disclosure.

FIG. 5 illustrates another example of a valve 504 locked to a fill port 506 of a reservoir of a printing device consistent with the disclosure. Valve 504, in some examples can be integrated with a tip 505 of a compress 500. The compress tip 505 can include a lock feature to lock to fill port 506 of a print materials reservoir. Valve 504 can be a rotating valve that opens responsive to rotation of valve 504 (e.g., about axis 515) with respect to the lock feature, as well as connection and rotation of the compress tip 505 with respect to fill port 506.

Valve 506 can prevent exposure of a compress tip 505 or fill port 506 entrance to a user. For instance, during docking and undocking, compress tip 505 swaps places with a cover of fill port 506. This can result in compress tip 505 and an entrance to fill port 506 in direct contact with each other. This can prevent residual print materials from falling out of the compress during removal by allowing fill port 506 to cleanly shear (e.g., at shear plane 513) a print materials column 511 between seal wipes.

In the example illustrated in FIG. 5, compress 500 is locked to fill port 506, such that print materials may pass through print materials column 511. While not illustrated here, prior to rotation of valve 504, valve 504 may not be locked with fill port 506, meaning print materials column 511 would be closed off and print materials would be unable to pass.

Figure 6:
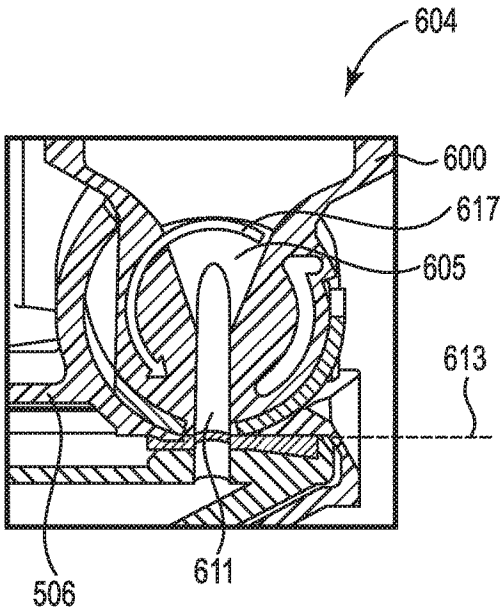
FIG. 6 illustrates yet another example of a valve locked to a replenishment port of a reservoir of a printing device consistent with the disclosure.

FIG. 6 illustrates yet another example of a valve 604 locked to a fill port 606 of a reservoir of a printing device consistent with the disclosure. Valve 604, in some examples can be integrated with a tip 605 of a compress 600. The compress tip 605 can include a lock feature to lock to fill port 606 of a print materials reservoir, Valve 604 can be a rotating valve that opens responsive to rotation of valve 604 with respect to the lock feature, as well as connection and rotation of the compress tip 605 with respect to fill port 606.

Valve 606 can prevent exposure of a compress tip 605 or fill port 606 entrance to a user. For instance, during docking and undocking, compress tip 605 swaps places with a cover of fill port 606. This can result in compress tip 605 and an entrance to fill port 606 in direct contact with each other. This can prevent residual print materials from falling out of the compress during removal by allowing fill port 606 to cleanly shear (e.g., at shear plane 613) a print materials column 611 between seal wipes.

In the example illustrated in FIG. 6, compress 600 is locked to fill port 606, such that print materials may pass through print materials column 611. While not illustrated here, prior to rotation of valve 604, valve 604 may unlock from fill port 606, meaning print materials column 611 would be closed off and print materials would be unable to pass.

Figure 7:
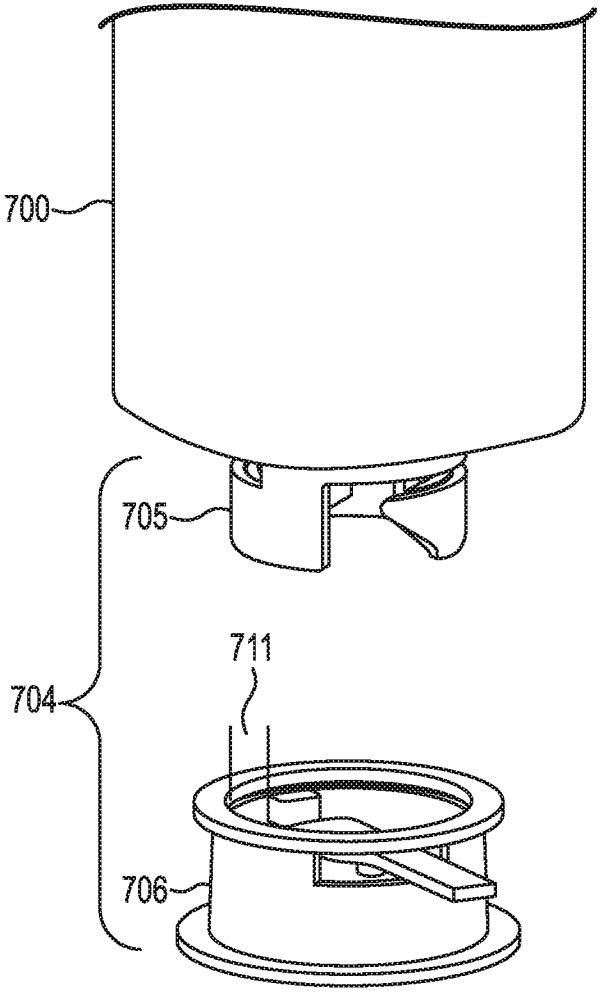
FIG. 7 illustrates another example of a valve locked to a replenishment port of a reservoir of a printing device consistent with the disclosure.

FIG. 7 illustrates another example of a valve 704 locked to a fill port 706 of a reservoir of a printing device consistent with the disclosure. Valve 704, in some examples can be integrated with a tip 705 of a compress 700. The compress tip 705 can include a lock feature to lock to fill port 706 of a print materials reservoir. Valve 704 can be a rotating valve that opens responsive to rotation of valve 704 with respect to the lock feature, as well as connection and rotation of the compress tip 705 with respect to fill port 706.

Valve 706 can prevent exposure of a compress tip 705 or fill port 706 entrance to a user. For instance, during docking and undocking, compress tip 705 swaps places with a cover of fill port 706. This can result in compress tip 705 and an entrance to fill port 706 in direct contact with each other. An axis of valve 704, print materials column 711, and compress 700 can be in line such that compress time 705 uncovers fill port 706 while docking, creating a seal and allowing print materials to pass through print materials column 711.

In the example illustrated in FIG. 7, compress 700 is not connected to fill port 706. While not illustrated here, compress 700 can be docked and locked to fill port 706 to allow print materials to pass through print materials column 711. Prior to rotation of valve 704, valve 704 may be unlocked from fill port 706, meaning print materials column 711 would be closed off and print materials would be unable to pass.

Figure 8:
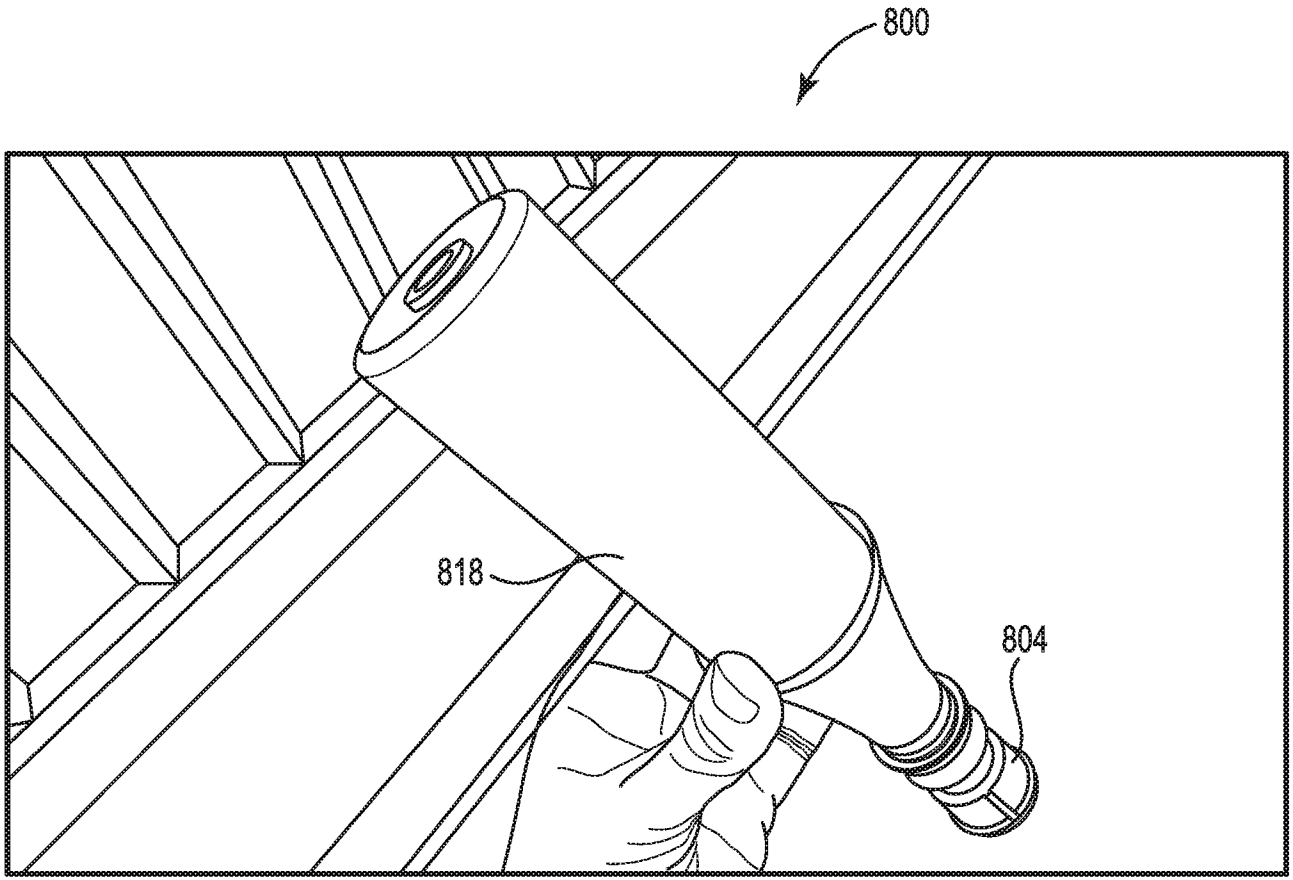
FIG. 8 illustrates an example of a print materials container having a bag mechanism consistent with the disclosure.

FIG. 8 illustrates an example of a print materials container 800 having a squeeze bottle mechanism 818 consistent with the disclosure. In some examples, squeeze bottle mechanism 818 can include valve 804 to facilitate transfer of print materials to a reservoir of a printing device. For instance, squeeze bottle mechanism 818 can house print materials that can be released through valve 804, which can be a one-way valve, to dispense the print materials.

Squeeze bottle mechanism 818 can be squeezed a plurality of times using a pumping action to dispense the print materials. This pumping action can aerate the print materials during dispensing in some instances. The pumping action can be repeated until the desired amount of print materials (e.g., all the print materials) have been dispensed through valve 804 into the reservoir of the printing device. Valve 804 can be received by a fill port of the printing device to facilitate the transfer of print materials, in some examples.

Figure 9:
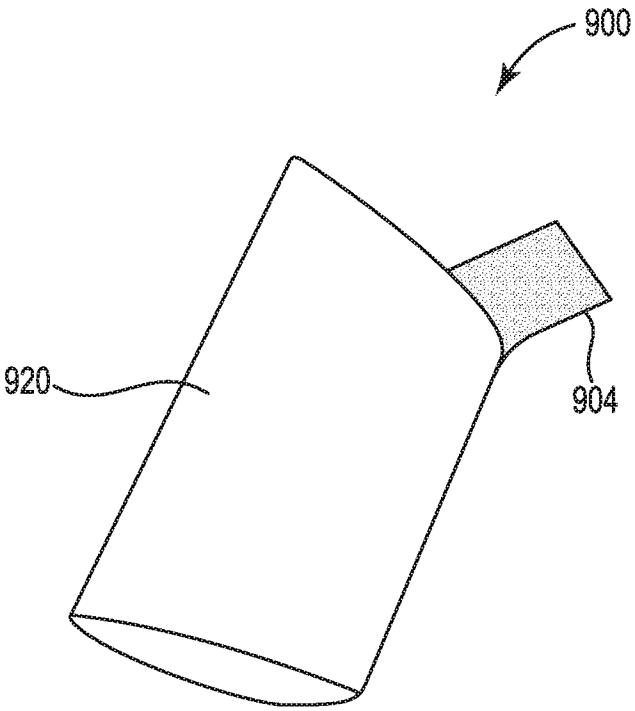
FIG. 9 illustrates an example of a print materials container having a squeeze bottle mechanism consistent with the disclosure.

FIG. 9 illustrates an example of a print materials container 900 having a bag mechanism 920 consistent with the disclosure. In some examples, bag mechanism 920 can include valve 904 to facilitate transfer of print materials to a reservoir of a printing device. For instance, bag mechanism 920 can house print materials that can be released through valve 904, which can be a one-way valve, to dispense the print materials.

For example, bag mechanism 920 can be squeezed a plurality of times using a pumping action to dispense the print materials. This pumping action can aerate the print materials during dispensing in some instances. The pumping action can be repeated until the desired amount of print materials (e.g., all the print materials) have been dispensed through valve 904 into the reservoir of the printing device. Valve 904 can be received by a fill port of the printing device to facilitate the transfer of print materials, in some examples. In some instances, compressed air can be used to dispense the print materials alternatively or in addition to the pumping action.

Figure 10:
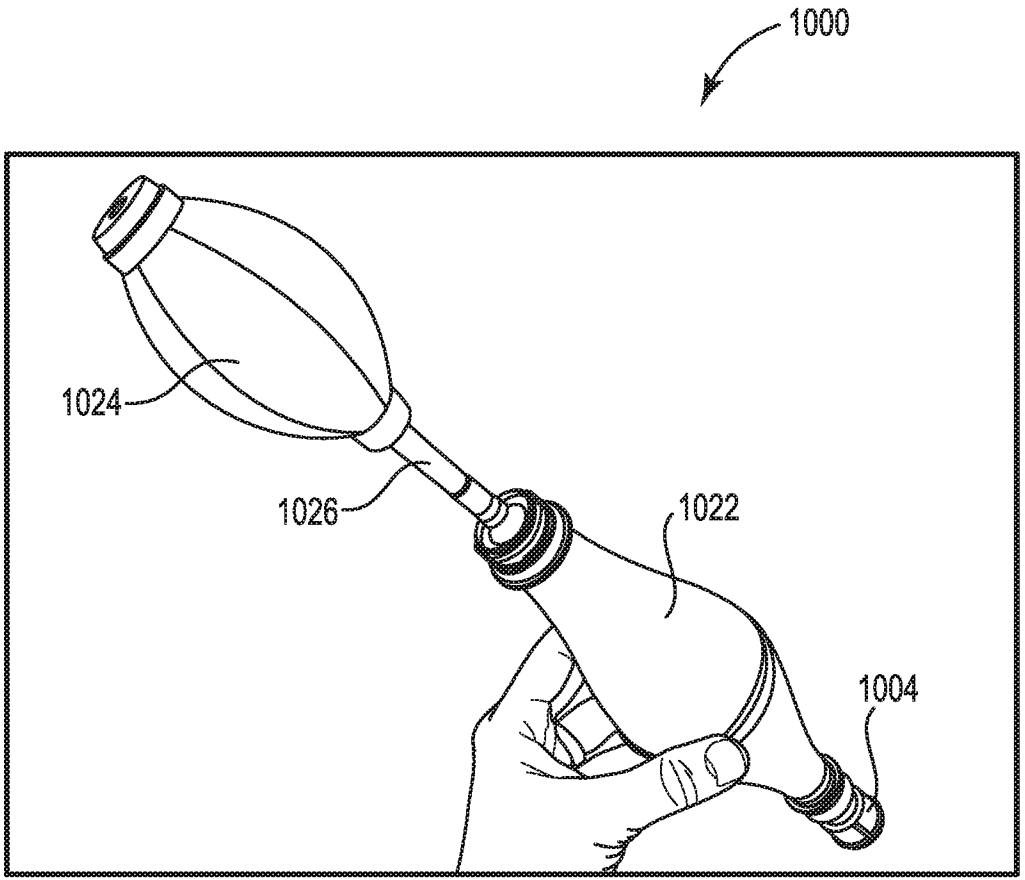
FIG. 10 illustrates an example of a print materials container having a bulb pump mechanism consistent with the disclosure.

FIG. 10 illustrates an example of a print materials container 1000 having a bulb pump mechanism consistent with the disclosure. For instance, the bulb pump mechanism can include a bulb pump 1024 coupled to a canister 1022 via tube 1026. In some examples, the bulb pump mechanism can include valve 1004 to facilitate transfer of print materials to a reservoir of a printing device, For instance, cannister 1022 can house print materials that can be released through valve 1004, which can be a one-way valve, to dispense the print materials.

Bulb pump 1024 can be squeezed a plurality of times using a pumping action to dispense the print materials. This pumping action can aerate the print materials during dispensing in some instances. The pumping action can be repeated until the desired amount of print materials (e.g., all the print materials) have been dispensed from cannister 1022 through valve 1004 into the reservoir of the printing device. Valve 1004 can be received by a fill port of the printing device to facilitate the transfer of print materials, in some examples.

Figure 11:
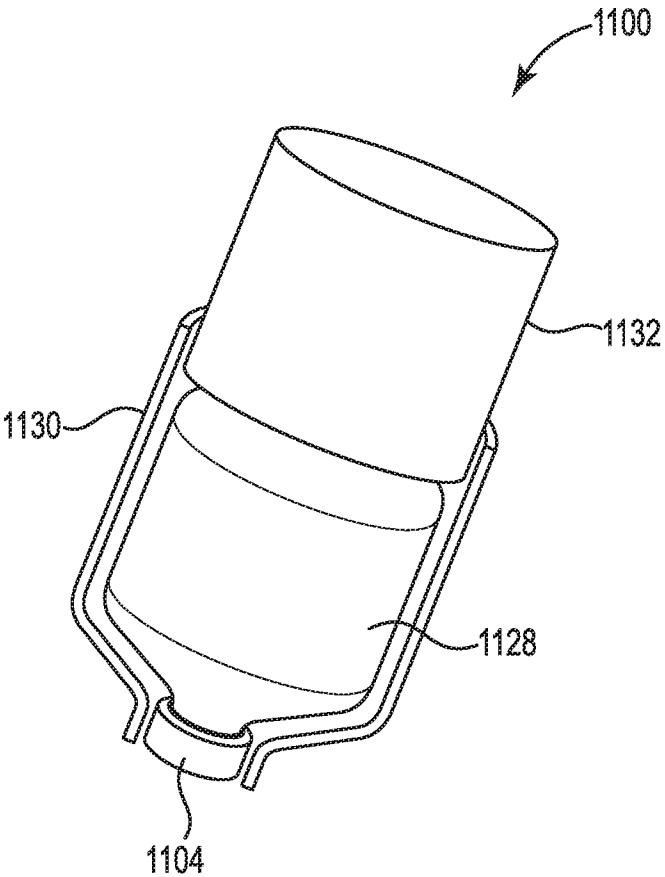
FIG. 11 illustrates an example of a print materials container having a smooth container within a compression mechanism consistent with the disclosure.

FIG. 11 illustrates an example of a print materials container 1100 having a smooth container 1128 within a compression mechanism 1130 consistent with the disclosure. Smooth container 1128 can be a bag or other container that can receive a force. Compression mechanism 1130 can house smooth container 1128 storing print materials. In such an example, smooth container 1128 can be inside compression mechanism 1130 such that when a force is applied to plunger 1132, print materials are dispensed via valve 1104 to a printing device reservoir as smooth container 1128 is compressed. Valve 1104 can be received by a fill port of the printing device to facilitate the transfer of print materials, in some examples.

Smooth container 1128 can be removable from compression mechanism 1130, in some instances. For instance, smooth container 1128 can be a container that can be placed in compression mechanism 1130 for filling/replenishing of a printing device reservoir. Smooth container 1128 can be removed from compression mechanism 1130 upon completion of filling/replenishing of the printing device reservoir.

Figure 12:
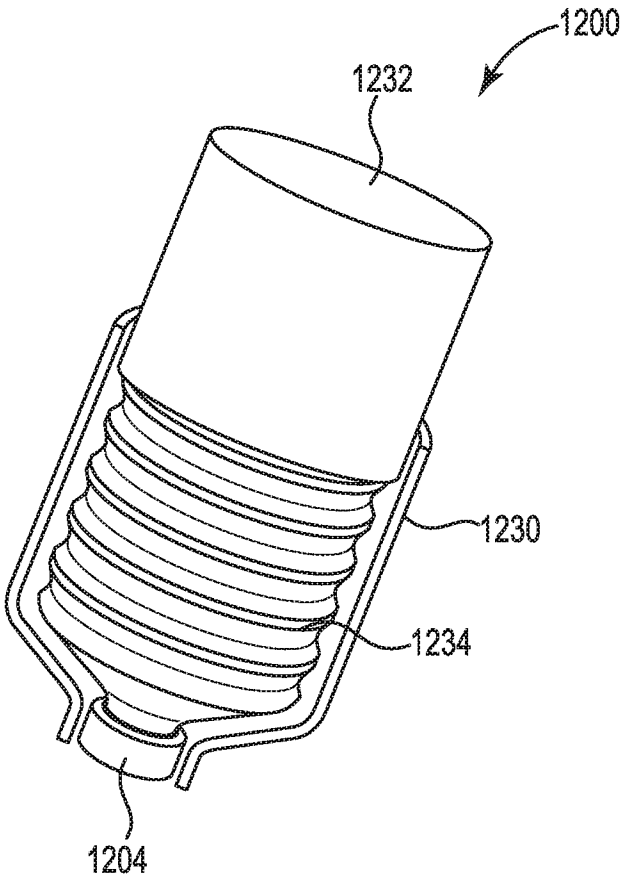
FIG. 12 illustrates an example of a print materials container having an accordion-shaped collapsible container consistent with the disclosure.

FIG. 12 illustrates an example of a print materials container 1200 having an accordion-shaped collapsible container 1234 within a mechanism 1230 consistent with the disclosure. Accordion-shaped collapsible container 1234 can be a bag or other container that can receive a force. Mechanism 1230 can house accordion-shaped collapsible container 1234 storing print materials. In such an example, accordion-shaped collapsible container 1234 can be inside mechanism 1230 such that when a force is applied to plunger 1232, print materials are dispensed via valve 1204 to a printing device reservoir as accordion-shaped collapsible container 1234 is compressed. Valve 1204 can be received by a fill port of the printing device to facilitate the transfer of print materials, in some examples.

Accordion-shaped collapsible container 1234 can be removable from mechanism 1230, in some instances. For instance, accordion-shaped collapsible container 1234 can be a container that can be placed in mechanism 1230 for filling/replenishing of a printing device reservoir. Accordion-shaped collapsible container 1234 can be removed from mechanism 1230 upon completion of filling/replenishing of the printing device reservoir. In some instances, accordion-shaped collapsible container 1234 can collapse on itself and remain collapsed upon completion of filling/replenishing of the printing device reservoir. Accordion-shaped collapsible container 1234, in some examples, can have a valve as described in FIGS. 4-7 for connection to and filling/replenishing of the printing device reservoir.

Figure 13:
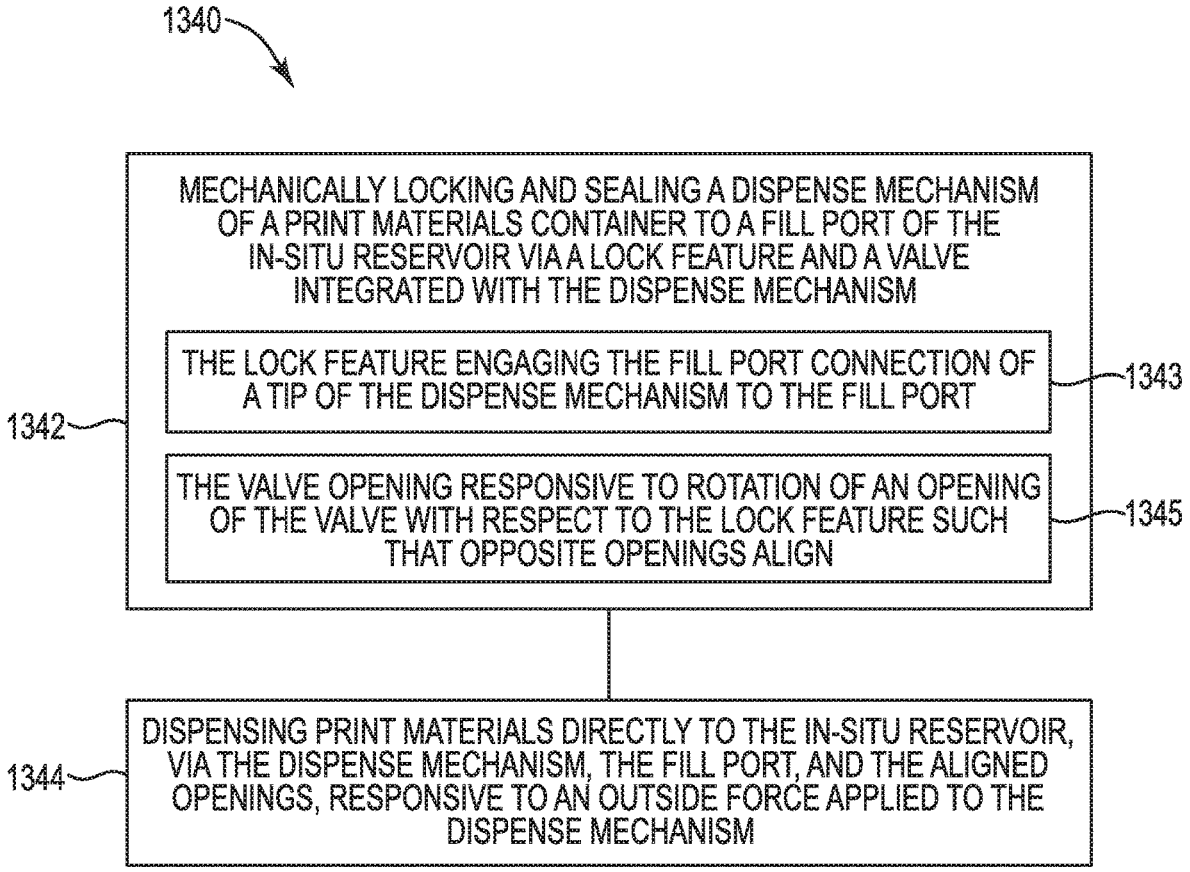
FIG. 13 illustrates a diagram of an example method for consistent with the disclosure.

FIG. 13 illustrates a diagram of an example method 1340 for refilling an in-situ reservoir of a printing device consistent with the disclosure. At 1342, method 1340 includes mechanically locking and sealing a dispense mechanism of a print materials container to a fill port of the in-situ reservoir via a lock feature and a valve integrated with the dispense mechanism. For instance, a dispense mechanism such as a compression mechanism, squeeze bottle mechanism, print material particle bag mechanism, or bulb pump mechanism, among others, can house print materials particles for supplying the reservoir. The reservoir can be in-situ such that it remains within a printing device during filling/replenishing.

In some examples, the dispense mechanism can be mechanically locked to the fill port responsive to a turn of the dispense mechanism. The turn can include sufficient rotation to enable connection of the fill port. For instance, the dispense mechanism can be coupled, or "locked" to a fill port by connecting the dispense mechanism to the fill port and turning and/or twisting the dispense mechanism. In some examples, the dispense mechanism may be turned and/or twisted a particular amount, for instance, 15 degrees, 30 degrees, 45 degrees, 90 degrees, or 180 degrees, among others. Other degree amounts or directions may be used, for instance a range of degrees or different coupling approaches. The interlocking connection can include the opening of valve doors on the dispense mechanism and/or the fill port to allow for transfer of print materials while avoiding spillage or spraying of print materials. Other interlocking connections and/or other coupling techniques may be used to couple the dispense mechanism to the fill port, for instance as described with respect to FIGS. 4-7.

Locking and sealing of the dispense mechanism can include the lock feature engaging the fill port during connection of a tip of the dispense mechanism to the fill port at 1343 and the valve opening responsive to rotation of an opening of the valve with respect to the lock feature such that opposite openings align at 1345. For instance, an opening created by the aligned openings can appear such that dispensing of print materials occurs when the dispense mechanism is locked to the fill port, but not when unlocked.

At 1344, method 1340 includes dispensing print materials directly to the in-situ reservoir, via the dispense mechanism, the fill port, and the aligned openings, responsive to an outside force applied to the dispense mechanism. For example, a plunger of the dispense mechanism can release a seal, which in turn can seal the print materials and dispense the print materials in response.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 102 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present, In contrast, when an object is "directly coupled to" or "directly coupled with" another element it is understood that are no intervening elements (adhesives, screws, other elements) etc.

The above specification, examples, and data provide a description of the method and applications and the use of the system and method of the disclosure, Since many examples can be made without departing from the spirit and scope of the system and method of the disclosure, this specification merely sets forth some of the many possible example configurations and implementations.

What is claimed is:

1. A print materials container, comprising:

a dispense mechanism to dispense print materials directly to an in-situ reservoir of a printing device;

a lock feature to engage a fill port during connection of the dispense mechanism to the fill port; and a valve integrated with the dispense mechanism for connecting the dispense mechanism to the fill port of the reservoir and comprising an output opening offset from a center axis of a tip of the dispense mechanism, wherein the valve opens responsive to rotation of the valve opening with respect to the lock feature such that opposite openings align.

2. The device of claim 1, wherein the dispense mechanism comprises a compression mechanism.

3. The device of claim 1, wherein the dispense mechanism comprises a squeeze bottle mechanism comprising a one-way valve to dispense the print materials.

4. The device of claim 1, wherein the dispense mechanism comprises a print materials bag mechanism comprising a one-way valve to dispense the print materials.

5. The device of claim 1, wherein the dispense mechanism comprises a bulb pump coupled to a canister storing print materials to dispense the print materials.

6. The device of claim 1, wherein the dispense mechanism comprises an accordion-shaped collapsible container storing print materials.

7. The device of claim 1, wherein the open valve facilitates a plunger of the dispense mechanism to push the print materials through the aligned openings into the reservoir.

8. A print materials container, comprising:

a dispense mechanism to dispense print materials to an in-situ reservoir of a printing device, the dispense mechanism comprising:

a compress storing the print materials and having a plunger to dispense the print materials responsive to a force applied at an end of the plunger; and a tip of the compress including a lock feature to lock to a fill port of the reservoir; and a rotating valve integrated with the tip of the compress to open responsive to rotation of the valve with respect to the lock feature and connection and rotation of the tip with respect to the fill port.

9. The print materials container of claim 8, further comprising:

the valve comprising an output opening offset from a center axis of the tip;

the lock feature to engage the fill port during connection of the tip to the fill port; and the valve to open responsive to rotation of the valve opening with respect to the lock feature such that opposite openings align, wherein the open valve facilitates the plunger to push the print materials through the aligned openings into the reservoir.

10. The print materials container of claim 8, further comprising a seal coupled to the plunger to protect the plunger from the print materials and sweep the print materials within the compress.

11. The print materials container of claim 10, wherein the seal comprises a felt material wipe seal.

12. The print materials container of claim 10, wherein the seal comprises a synthetic material wipe seal.

13. The print materials container of claim 8, wherein the plunger is removable from the dispense mechanism.

14. A method for refilling an in-situ reservoir of a printing device, comprising:

mechanically locking and sealing a dispense mechanism of a print materials container to a fill port of the in-situ reservoir via a lock feature and a valve integrated with the dispense mechanism, the locking and sealing comprising:

the lock feature engaging the fill port during connection of a tip of the dispense mechanism to the fill port; and the valve opening responsive to rotation of an opening of the valve with respect to the lock feature such that opposite openings align; and dispensing print materials directly to the in-situ reservoir, via the dispense mechanism, the fill port, and the aligned openings, responsive to an outside force applied to the dispense mechanism.

15. The method of claim 14, further comprising mechanically locking the dispense mechanism to the fill port responsive to a turn of the dispense mechanism.

16. The method of claim 14, further comprising a plunger of the dispense mechanism releasing a seal sealing the print materials and dispensing the print materials in response.

* * * * *